United States Patent [19]

Gross

[11] Patent Number: 4,871,989

[45] Date of Patent: Oct. 3, 1989

[54] SOLENOID WITH MANUAL ACTUATION MECHANISM

[75] Inventor: David M. Gross, Mount Prospect, Ill.

[73] Assignee: Synchro-Start Products, Inc., Skokie, Ill.

[21] Appl. No.: 182,093

[22] Filed: Apr. 15, 1988

[51] Int. Cl.[4] ..... H01H 9/20

[52] U.S. Cl. ..... 335/164; 335/255; 335/263; 251/129.03

[58] Field of Search ..... 335/164, 171, 255-256, 335/263; 251/129.03

[56] References Cited

U.S. PATENT DOCUMENTS

| | | | |
|---|---|---|---|
| 1,786,234 | 10/1930 | Forman . | |
| 2,051,938 | 8/1935 | Carlson . | |
| 2,239,312 | 4/1941 | Berges | 335/263 |
| 2,354,704 | 8/1941 | Ray . | |
| 2,415,739 | 2/1947 | Fuchs . | |
| 2,756,370 | 7/1956 | Meusy . | |
| 3,231,790 | 1/1966 | Vander Kaay et al. . | |
| 3,254,660 | 6/1966 | Ray . | |
| 4,262,271 | 4/1981 | Bowers et al. | 335/263 |
| 4,494,096 | 1/1985 | Fuzzell . | |
| 4,521,759 | 6/1985 | Gibas . | |
| 4,679,017 | 7/1987 | Mishler et al. . | |

FOREIGN PATENT DOCUMENTS

| | | |
|---|---|---|
| 2645887 | 7/1978 | Fed. Rep. of Germany . |
| 1200464 | 12/1958 | France . |
| 7816745 | 6/1978 | France . |
| 1052741 | 12/1966 | United Kingdom . |

*Primary Examiner*—E. A. Goldberg
*Assistant Examiner*—Lincoln Donovan
*Attorney, Agent, or Firm*—Kinzer, Plyer, Dorn, McEachran & Jambor

[57] ABSTRACT

A manual actuation mechanism for a solenoid having a plunger with one end connected to an external apparatus, such as a diesel engine fuel pump energization of the solenoid coil drives the plunger axially from an initial position to an actuation position. The manual actuation mechanism comprises a retraction rod that extends axially through the solenoid and is movable from a normal position disengaged from the plunger to a retraction position; in moving to its retraction position the rod drives the plunger to its actuated position, simulating energization of the coil. The manual actuation mechanism further includes a retainer comprising a spring clamp mounted on the housing and projecting into firm, resilient gripping engagement with the rotary actuator to preclude vibrational or other incidental rotation of the actuator regardless of its position. The spring clamp also serves as a strain relief for electrical connections to the solenoid.

6 Claims, 1 Drawing Sheet

SOLENOID WITH MANUAL ACTUATION MECHANISM

BACKGROUND OF THE INVENTION

One conventional application for a solenoid is in the fuel system for a diesel engine, as in a diesel powered truck, automobile, or other vehicle. The solenoid plunger is connected to the fuel pump so that the plunger is at its maximum extension when the solenoid is de-energized. For this operating condition, the fuel supply to the diesel engine is cut off. When the engine is to be started, the solenoid is energized to retract its plunger and thus allow the fuel pump to supply fuel to the engine. Usually, a dual coil solenoid is employed, incorporating a pulling coil and a holding coil. Both coils are energized to retract the solenoid plunger. When the retraction movement of the plunger is completed, the pulling coil is de-energized but the holding coil remains energized to keep the plunger retracted. To shut off the engine, the holding coil is de-energized; a return spring in the solenoid restores the plunger to its initial extended position. Similar solenoid uses occur with stationary engines and in other applications.

In an arrangement of this kind, an electrical failure in the solenoid or in its electrical circuits may preclude energization of the solenoid coils, particularly the pulling coil. In these circumstances, with many solenoids it is essentially impossible to retract the solenoid plunger to allow operation of the engine long enough to get the truck or other vehicle to a location where repairs can be conveniently effected. Thus, it may be necessary to tow the vehicle to a repair facility. In industrial applications, a similar electrical failure may cause a costly interruption in a critical industrial process.

To meet these difficulties, solenoids have been equipped with mechanisms to enable manual actuation of the solenoid to simulate normal electrical operation. Several different embodiments of manual actuation mechanisms for solenoids are disclosed in Mishler et al U.S. Pat. No. 4,679,017. Each of those manual actuator mechanisms includes some form of retainer means to preclude accidental, unwanted actuation caused by vibration, by tinkerers who don't know what the manual actuator does, or from other incidental sources. Another example of a device equipped with a manual actuator is shown in Arnold West German patent publication No. 26 45 887, directed to a solenoid-operated valve. By incorporation of effective, vibration-proof retainer constructions in such solenoids tends to increase their cost undesirably and may make operation of the manual actuator mechanism awkward, difficult, or difficult to understand.

SUMMARY OF THE INVENTION

It is an object of the invention to provide an actuation mechanism for a solenoid that includes a retainer drive that is simple and inexpensive, yet highly reliable in preventing accidental actuation due to vibration or other incidental effects.

Another object of the invention is to provide a new and improved retainer for a rotary actuator, in a manual actuation mechanism for a solenoid, that effectively precludes undesirable rotation of the actuator due to vibration and other incidental effects, and that also affords an effective strain relief for the electrical connections to the solenoid.

Accordingly, the invention relates to a solenoid of the kind comprising a housing, a magnetic plunger in the housing, axially movable between an initial position and an actuation position, one end of the plunger being accessible through the front of the housing for an external operating connection, spring means biasing the plunger toward its initial position, and electrical coil means for driving the plunger to its actuation position. The solenoid includes a manual actuation mechanism comprising a retraction rod axially movably mounted in the housing in alignment with the plunger, the retraction rod having a normal position effectively disengaged from the plunger, first connecting means for interconnecting the retraction rod and the plunger, and a manually operated rotary actuator mounted in the back of the housing and rotationally movable between a first position and a second position, movement of the actuator to its second position moving the retraction rod axially from its normal position to a retraction position, with movement of the rod to its retraction position driving the plunger to its actuation position. The manual actuation mechanism further comprises retainer means for retaining the rotary actuator in its respective first and second positions; that the retainer means comprises a spring retainer clamp mounted on the housing and projecting into firm, resilient gripping engagement with the rotary actuator to preclude vibrational or other incidental rotation of the actuator.

DESCRIPTION OF THE PREFERRED EMBODIMENTS

Figure 1:
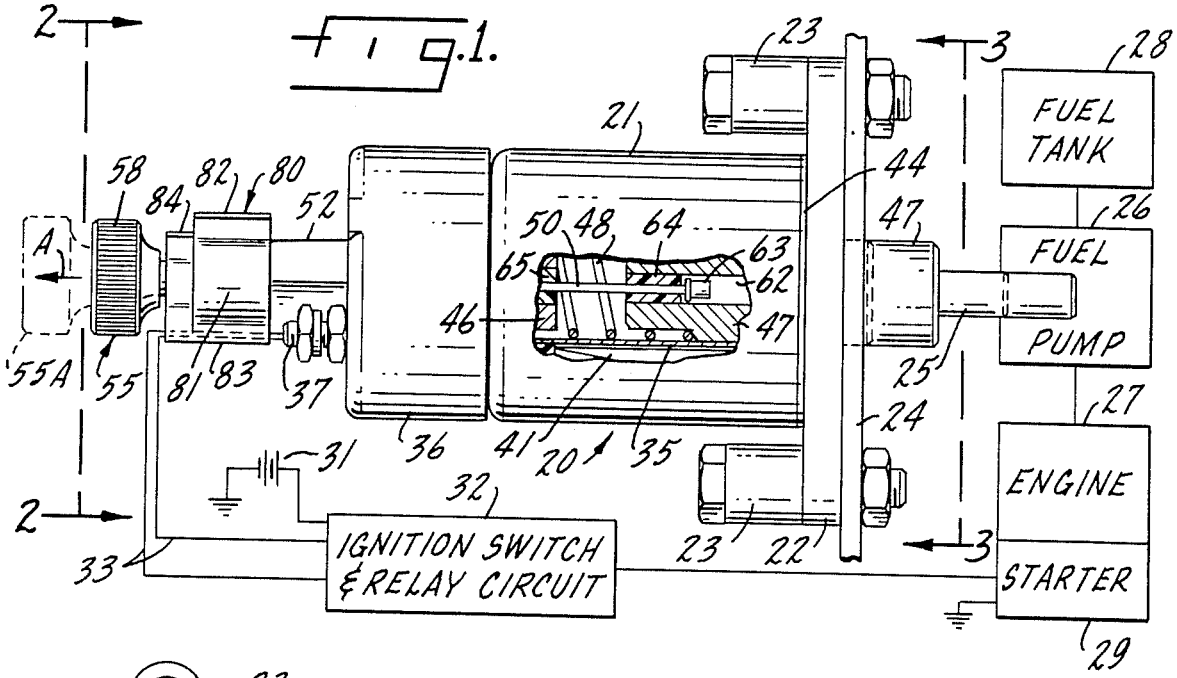
FIG. 1 is a partially cut-away side elevation view of a solenoid, de-energized, incorporating a manual actuation mechanism in accordance with one embodiment of the invention, connected in a diesel engine fuel supply system.

FIGS. 1-4 illustrate a solenoid 20 comprising a cylindrical main housing 21 of magnetic steel tubing affixed at one end to a mounting flange plate 22. Two bushings 23 on flange plate 22 afford a convenient means for mounting the solenoid on an external support 24 (FIG. 1). A plunger rod 25 projects outwardly from the front end of housing 21, beyond plate 22 and support 24. Rod 25 is utilized to connect solenoid 20 to an external mechanism such as the fuel pump 26 of a diesel engine 27 in a truck, automobile, or other vehicle, or in an industrial application.

The fuel supply system for engine 27, as shown schematically in FIG. 1, in addition to fuel pump 26, includes a fuel tank 28 and a starter motor 29. The starter 29, which is mechanically connected to engine 27, is electrically connected to a battery 31 through an ignition switch and relay circuit 32. Circuit 32 also serves to connect the battery to solenoid 20 through a pair of conductors 33.

Figure 4:
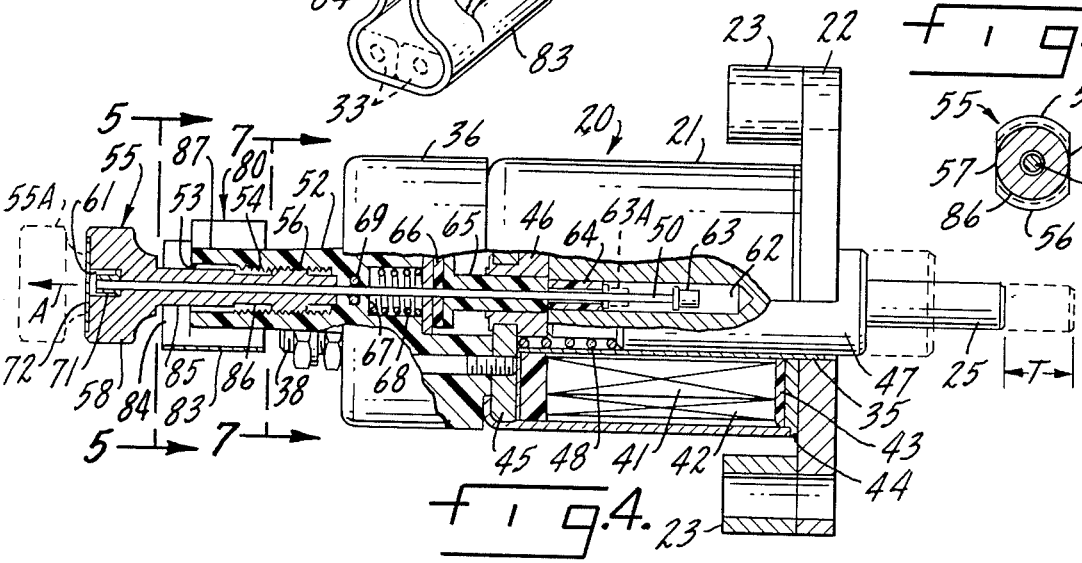
FIG. 4 is a partially sectional elevation view of the solenoid, energized, as seen from the same aspect as in FIG. 1.

At the rear end of solenoid 20, the end opposite flange plate 22 and plunger rod 25, there is a molded resin electrical housing 36. Housing 36 encloses a switch (not shown) for the electrical operating coils of the solenoid; on the other hand, solenoid 20 may have no switch incorporated in housing 36, in which case any coil-switching functions may be performed in circuit 32. Two electrical connection terminals, posts 37 and 38, project outwardly from housing 36. In solenoid 20 posts 37 and 38 afford electrical connections to each of two electrical coils, a pulling coil 41 and a holding coil 42, through the solenoid switch; coils 41 and 42 appear in FIG. 4. Coils 41 and 42 are mounted on a coil support or bobbin 43 disposed in encompassing relation to a brass sleeve or liner 35 inside housing 21 (FIG. 4). In a switchless solenoid a third connection post would usually be provided.

Starting at the front end of solenoid 20, adjacent its mounting plate 22, in FIG. 4, the magnetic circuit for the solenoid comprises a front end plate 44 and flange 22, housing 21, a rear end plate or attraction plate 45, and a cylindrical attraction stud 46 mounted on plate 45 and extending axially into a brass liner or sleeve 35. The magnetic main solenoid plunger 47, on which plunger rod 25 is mounted, is disposed within sleeve 35 and is biased toward its initial position (illustrated in FIG. 1) by a return spring 48.

As thus far described, solenoid 20, FIGS. 1–4, is essentially conventional in construction and operation. When the solenoid is in the deenergized condition shown in solid lines in FIG. 1, with its plunger rod 25 fully extended, fuel pump 26 is shut off. To permit the fuel pump to operate so that engine 27 can run, coils 41 and 42 are electrically energized through circuit 32 and the external connection posts 37 and 38. The magnetic flux generated by the coils in the magnetic circuit of solenoid 20, described above, drives plunger 47 and rod 25 toward attraction stud 46, overcoming the bias afforded by return spring 48 (FIG. 4). When the inner end of plunger 47 contacts stud 46, the total travel for plunger 47 and its connecting rod 25 is complete and the plunger is in its retraction position as shown in solid lines in FIG. 4 and in dash lines in FIG. 1. The plunger travel distance T (FIG. 4) may vary, depending upon the requirements of the equipment with which solenoid 20 is used. Typically, T may be 12 mm, 16 mm, or more. When the solenoid plunger has completed its full retraction travel T, the main pulling coil 41 is deenergized by operation of the switch in housing 36, because a substantially reduced magnetic force is adequate to hold the plunger in its retraction position against stud 46.

Figure 7:
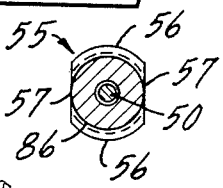
FIG. 7 is a detail sectional view, on the same scale as FIGS. 5 and 6, taken approximately as indicated by line 7—7 in FIG. 5.

Solenoid 20 includes a manual actuation mechanism that is shown in its normal, unactuated condition in the solid line portions of both FIG. 1 and FIG. 4. This mechanism comprises a retraction rod 50 that is axially movably mounted in the back end of solenoid 20, the end opposite plunger connection rod 25. The outer end of rod 50 extends through a cylindrical guide 52 that is formed integrally with and projects axially outwardly from terminal housing 36. The outer end of guide 52 encompasses a long socket 53 that has an elongated internal thread portion 54. A manually operated rotary actuator 55 is mounted in socket 53. Near one end of actuator 55 there is a thread 56 engaging the thread 54 in socket 53; the threaded portion 56 of actuator 55 is appreciably shorter than the thread 54 in guide 52. In the preferred construction (FIG. 7) the thread 56 is peripherally interrupted; there are two flats 57 on opposite sides of the actuator. The outer end of actuator 55 comprises an enlarged knob 58.

Retraction rod 50 that extends axially of the solenoid from a short socket 61 in the outer end of actuator 55 into an elongated axial socket 62 in plunger 47. A ferrule or flange 63 is mounted on the innermost end of rod 50, the end of the rod that is positioned in plunger socket 62. Ferrule 63 affords a shoulder on the retraction rod that is aligned with the inner end or shoulder of a sleeve 64 mounted in the entrance of socket 62. Sleeve 64 may be press fit into the outer end of plunger socket 62.

Between sockets 61 and 62, rod 50 extends through an axial aperture in a molded resin guide 65, through a washer 66, and through a spring socket 67, molded into the housing 36, in which a switch spring 68 is mounted. An O ring seal 69 around rod 50, within housing 36, is provided to preclude entry of dirt and other contaminants into the interior of solenoid 20 along rod 50. A ferrule or flange member 71 is mounted on the outer end of rod 50, in socket 61. A cover 72 may be provided over socket 61. Rod 50 is axially movable within solenoid 20, as described more fully hereinafter, within the limits determined by the flanges 63 and 71.

A retainer clip 80, mounted on the guide portion 52 of housing 36, is employed to preclude unwanted rotational movement of actuator 55 due to vibration or other incidental factors. In solenoid 20, retainer 80 is a strong spring steel clip with two arcuate main mounting arms 81 each ending in an angularly projecting end portion 82. The ends of the arms 81 opposite projections 82 are joined by an integral C-shaped bight portion 83. One solenoid 20, clip arms 81 tightly embrace a portion 87 of the housing guide 52 that has a circular external configuration except for a stop or boss 88 that projects between clip arm and portions 82. The inner adjacent portion of guide 52, not engaged by clip 80, may be hexagonal or any other shape, preferably affording a shoulder to provide a positive axial position for the retainer clip.

The axially outermost part of the spring retainer clip 80 (see FIGS. 1 and 4) has two smaller arms 84 projecting from the bight portion 83. These arms 84 extend into firm, resilient gripping engagement with an elongated, unthreaded main shaft portion 85 of the rotary actuator 55. The main shaft portion 85 of actuator 55 is axially spaced from its threaded portion 56 by a short, unthreaded segment 86 of a slightly reduced diameter (FIG. 4).

As long as solenoid 20 functions normally, there is no need to use its manual actuation mechanism. Whenever it is necessary or desirable to have the solenoid plunger 47 and its connection rod 25 moved from the initial position shown in FIG. 1 to the retraction position of FIG. 4, this is accomplished by electrical energization of coils 41 and 42 as described above. Plunger 47 is held in its retraction position (FIG. 4) by maintaining energization of holding coil 42, under control of the switch (not shown) in housing 36. To return solenoid 20 to its initial operating condition, with plunger 47 and rod 25 fully extended, it is only necessary to deenergize holding coil 42. If there is an electrical failure in the solenoid or in its external electrical circuits, however, this normal mode of operation cannot be employed. In these circumstances, if it is necessary or desirable to actuate solenoid 20 to retract plunger 47 and connecting rod 25, its manual actuation mechanism is utilized.

Figure 2:
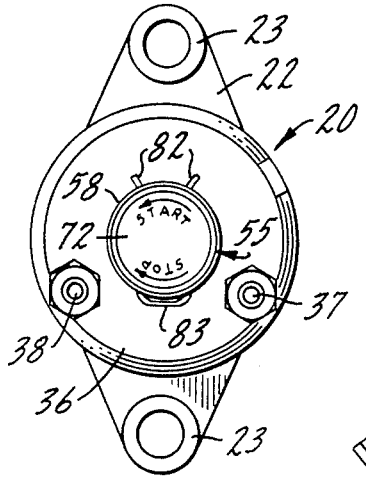
FIG. 2 is an end view of the solenoid, taken approximately as indicated by line 2—2 in FIG. 1.

To actuate solenoid 20 manually from the normal condition of FIG. 1 to the actuated condition for plunger 47 shown in solid lines in FIG. 4, the operator grasps knob 58 to rotate actuator 55 counterclockwise, in the "start" direction of FIG. 2 (right-hand threads 54,56 are assumed). Continued counterclockwise rotation moves actuator 55 axially in the direction of the arrow A through the distance T to the dash line position 55A, FIGS. 1 and 4. As actuator 55 moves, it pulls retraction rod 50 along in the direction A, through the distance T from its initial position just disengaged from sleeve 64 in plunger 47 (see detail in FIG. 1) until the retraction rod reaches the retraction position indicated by dash outline 63A in FIG. 4. Spring 48 resists this action; actuator 55 affords a mechanical advantage sufficient to allow a person of ordinary hand strength to overcome the spring bias. Alternatively, knob 58 may be slotted or otehrwise configured to allow use of a tool for greater mechanical advantage. The axial movement of rotary actuator 55, moving retraction rod 50 the distance T from its normal position (solid lines, FIGS. 1, 4) to its retraction position (63A, FIG. 4), shifts plunger 47 from its initial position (FIG. 1) to its actuation position (FIG. 4).

At the end of the rotary and translational movement of actuator 55, the actuator thread 56 moves clear of the thread in housing guide 52. This is signalled to the operator by the fact that continued counterclockwise rotation of actuator 55 produces no additional axial movement of the actuator and by the gripping arms 84 snapping inwardly a very short distance (e.g. 0.007 inch) into engagement with the reduced-diameter portion 86 of the actuator. At this point actuator 55 is in its second position 55A and has pulled retraction rod 50 from its normal position, shown in solid lines in FIGS. 1 and 4, to its second position indicated by ferrule 63A in FIG. 4; plunger 47 has been driven from its initial position (FIG. 1) to its actuation position (FIG. 4). The external apparatus actuated by solenoid 20, such as fuel pump 26, is controlled in the same way as if the solenoid were energized.

Manual restoration of solenoid 20 to its original operating condition, with the solenoid electrically deenergized, is equally simple. Knob 58 is used to rotate actuator 55 clockwise, as indicated by the "stop" arrow in FIG. 2. This re-engages threads 54 and 56 and causes actuator 55 to move back into guide 52, in the direction opposite arrow A. As the actuator returns to its first position, spring 48 drives plunger 47 back to its initial position and this movement of the plunger pulls rod 50 back to its normal position. Thus, fuel pump 26 (or any other mechanism controlled by solenoid 20) is restored to its original operating condition.

Retainer clip 80, by the firm, resilient grip of its arms 84 on the unthreaded shaft portion 85 of actuator 55, effectively precludes unwanted rotary motion of the actuator due to vibration and other incidental external effects. The retainer clip serves as a stop limiting inward movement of the actuator knob 58, in the direction opposite arrow A. Thus, retainer 80 defines the first position for the actuator and hence the normal position for retraction rod 50.

Figure 5:
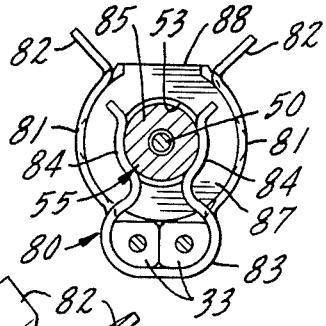
FIG. 5 is a detail sectional view on an enlarged scale, taken approximately as indicated by line 5—5 in FIG. 4, showing a retainer clip embodying principal features of the invention.
Figure 3:
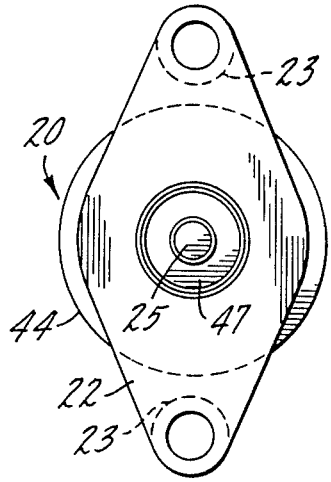
FIG. 3 is an end view taken approximately as indicated by line 3—3 in FIG. 1.
Figure 6:
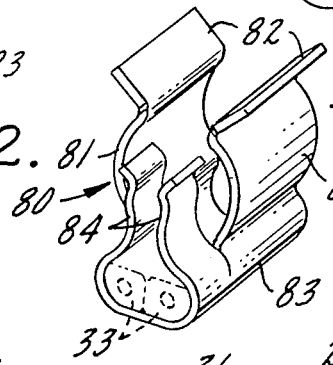
FIG. 6 is a perspective view of the retainer clip of FIG. 5.

Retainer 80 also serves another important function. Its bight portion 83 is given a configuration such that the electrical conductors 33 can be pulled, in a tight, compressed fit, through portion 83 as shown in FIG. 5. Thus, clip 80 affords a strain relief for the electrical connections to solenoid 20.

The manual actuator mechanism for solenoid 20 is readily adaptable to differing requirements for the solenoid stroke T. For a longer stroke T, a changeover to a longer retraction rod 50 and a corresponding change in the threaded portion 56 of rotary actuator 55 effect the desired change. There is no need to change housing 36 or its guide portion 52 if the required change in stroke T is not excessive. Of course, all such changes are limited by the overall length of the threaded portion 54 of guide 52 and by other dimensional characteristics of solenoid 20. However, a reasonable range for solenoid stroke T can be achieved with one basic construction, and one retainer clip 80 can serve many diffrent size solenoids.

In addition to its functions in eliminating the effects of vibration and as an electrical strain relief, spring steel clip 80 serves to reinforce and protect guide portion 52 of housing 36. Rotation of the clip on guide 52 is blocked by boss 88 between clip arm projections 82.

I claim:

1. In a solenoid of the kind comprising:

a housing;

a magnetic plunger in the housing, axially movable between an initial position and an actuation position, one end of the plunger being accessible through the front of the housing for an external operating connection;

spring means biasing the plunger toward its initial position;

and electrical coil means for driving the plunger to its actuation position;

the solenoid including a manual actuation mechanism comprising:

a retraction rod axially movably mounted in the housing in alignment with the plunger, the retraction rod having a normal position effectively disengaged from the plunger;

first connecting means for interconnecting the retraction rod and the plunger;

a manually operated rotary actuator mounted in the back of the housing and rotationally movable between a first position and a second position, movement of the actuator to its second position moving the retraction rod axially from its normal position to a retraction position, with movement of the rod to its retraction position driving the plunger to its actuation position;

and retainer means for retaining the rotary actuator in its respective first and second positions;

in which the retainer means comprises a spring retainer clamp mounted on the housing and projecting into firm, resilient gripping engagement with the rotary actuator to preclude vibrational or other incidental rotation of the actuator, the spring retainer clamp comprising a double clamp having a first pair of resilient arms disposed in firm, resilient gripping engagement with a portion of the solenoid housing to mount the clamp on the housing and a second pair of resilient arms gripping the actuator.

2. A solenoid with a manual actuation mechanism, according to claim 1, in which both sets of gripping arms project from a common bight portion of the retainer clamp, which bight portion comprises a strain relief for electrical connections to the electrical coil means of the solenoid.

3. A solenoid with a manual actuation mechanism, according to claim 1, in which the first pair of resilient arms embraces a cylindrical guide formed integrally with and projecting axially from the solenoid housing, in which the rotary actuator extends into the guide and has a threaded portion engaging a thread on the guide, and in which the second pair of resilient arms grips an unthreaded portion of the rotary actuator.

4. A solenoid with a manual actuation mechanism, according to claim 3, in which the axial length of the first pair of resilient arms is substantially greater than the axial length of the second pair of reslient arms, and in which the unthreaded portion of the rotary actuator is of constant diameter except for a section of slightly different diameter that is engaged by the second pair of resilient arms only when the rotary actuator is in its second position.

5. A solenoid with a manual actuation mechanism, according to claim 4, in which both sets of gripping arms project from a common bight portion of the retainer clamp, which bight portion comprises a strain relief for electrical connections to the electrical coil means of the solenoid.

6. A solenoid with a manual actuation mechanism, according to claim 1, in which the only path of entry of contaminants from the manual actuation mechanism into the interior of the solenoid housing is along the periphery of the retraction rod, and further comprising an O-ring seal mounted in the housing and disposed in sealing engagement with the retraction rod.

* * * * *